United States Patent [19]

Jerlich et al.

[11] Patent Number: 4,880,481

[45] **Date of Patent: * Nov. 14, 1989**

[54] PUNCH AND COUNTER PUNCH PLATES

[75] Inventors: Werner J. Jerlich; Alfred Kügler, both of Mürzzuschlag; Hans Kaiserfeld, Krieglach; Anton Schulhofer, Langenwang; Werner Zechner, Kapfenberg, all of Austria

[73] Assignee: Böhler Ges.m.b.H., Kapfenberg, Austria

[ * ] Notice: The portion of the term of this patent subsequent to Jan. 14, 2003 has been disclaimed.

[21] Appl. No.: 167,018

[22] Filed: Mar. 11, 1988

Related U.S. Application Data

[63] Continuation-in-part of Ser. No. 861,419, May 9, 1986, abandoned.

[30] Foreign Application Priority Data

May 21, 1985 [AT] Austria ..... 1529/85

[51] Int. Cl.[4] ..... C22C 38/20; C22C 38/40

[52] U.S. Cl. ..... 148/325; 148/326; 148/327; 420/60; 420/61; 420/49; 420/58

[58] Field of Search ..... 148/325, 326, 327, 12.4

[56] References Cited

U.S. PATENT DOCUMENTS

| | | | |
|---|---|---|---|
| 3,376,780 | 9/1966 | Tanczyn | 148/326 |
| 3,574,601 | 4/1971 | Myers et al. | 420/38 |
| 4,540,424 | 9/1985 | Yamakami et al. | 420/34 |
| 4,564,566 | 1/1986 | Jerlich et al. | 428/687 |

*Primary Examiner*—Deborah Yee

*Attorney, Agent, or Firm*—Werner W. Kleeman

[57] ABSTRACT

Punch and counter punch plates are fabricated from chromium containing alloys, essentially consisting of, each in percent by weight, carbon in the range of 0 to 1.1, silicon in a maximum of 1.0, manganese in a maximum of 1.5, chromium in the range of 11.0 to 17.5, molybdenum in the range of 0 to 1.5, nickel in the range of 0.35 to 10.0, copper in the range of 0 to 4.5, vanadium in the range of 0 to 0.5, cobalt in the range of 0 to 1.5, niobium in the range of 0 to 0.45, titanium in the range of 0 to 1.5, nitrogen in the range of 0 to 0.1, the remainder being iron and impurities resulting from the manufacturing conditions.

6 Claims, No Drawings

PUNCH AND COUNTER PUNCH PLATES

CROSS REFERENCE TO RELATED PATENT

The present application is a continuation-in-part of our cognate patent application Ser. No. 06/861,419,filed on May 9, 1986 and entitled: "CHROMIUM CONTAINING ALLOY FOR FABRICATING PUNCH AND COUNTER PUNCH PLATES", now abandoned, which, in turn, is related to the commonly assigned U.S. Pat. No. 4,564,566, granted Jan. 14, 1986, entitled "CHROMIUM CONTAINING ALLOY FOR FABRICATING PRESSING TOOLS, PRESSING PLATES FORMED FROM SUCH ALLOY AND METHOD OF FABRICATION THEREOF", the disclosure of which is incorporated herein by reference.

BACKGROUND OF THE INVENTION

The present invention relates to a new and improved punch and counter punch plate which are fabricated from chromium containing alloys and employed, for example, in punching or stamping machines.

Punch and counter punch plates are tools which are machined on all sides by shaping, milling or grinding and which are provided with bores and recesses aligned with the punching or stamping machine for affixing these tools at such machine and for determining or fixing cutting lines.

These tools or punch and counter punch plates must have high hardness and must meet the special requirements with regard to plane parallelism and flatness or planeness.

Raw materials or blanks employed for punch and counter punch plates are preferably hardened plates made from low-alloy or medium-alloy heat-treatable steels or tool steels such as, for example, DIN (German Industrial Standard) 50 CrMo 4, VEW (Vereinigte Edelstahlwerke) Material Number 1.7228 and AISI (American Iron and Steel Institute) 4150 having a case hardness in the range of 45 to 53 HRC. According to experience, these steel alloys are highly resistant to abrasion or wear when hardened or tempered.

These steel alloys, however, are not resistant to rust. When a film of moisture forms on the surface, for example, by climatically caused condensation of air humidity during changes of temperature, a thin, brownly colored punctiform coating of rust forms on the surface in the beginning stage. This coating of rust would contaminate products made of paper, cardboard or corrugated board and therefore must be removed by time-consuming maintenance before beginning production. The removal of the coating of rust is accomplished by wiping or polishing depending on the thickness of such rust coating. In addition to the expense for cleaning maintenance, an additional reduction in the service life can occur due to unfavorable environmental conditions such as, for example, in tropical climates, at locations near the sea or by storing the tools in the open.

A special type of corrosion, namely stress corrosion cracking, further appears in these punch and counter punch plates because, as can be easily imagined, especially high stresses occur in the punch and counter punch plates due to the punching pressures.

SUMMARY OF THE INVENTION

Therefore, with the foregoing in mind, it is a primary object of the present invention to provide a new and improved punch and counter punch plate which is fabricated from chromium containing alloys and does not exhibit the aforesaid drawbacks and shortcomings of the prior art alloys.

Another and more specific object of the present invention aims at providing a new and improved punch and counter punch plate which is fabricated from chromium containing alloys and which has markedly improved usefulness particularly with regard to withstanding heavy corrosive stresses existing during punching operations.

Now in order to implement these and still further objects of the invention, which will become more readily apparent as the description proceeds, the punch and counter punch plate of the present development is manafested by the features that, the punch and counter punch plate are fabricated from a chromium containing alloy which essentially consists of, each in percent by weight:

| | | |
|---|---|---|
| carbon | in the range of | 0 to 1.1 |
| silicon | in a maximum of | 1.0 |
| manganese | in a maximum of | 1.5 |
| chromium | in the range of | 11 to 17.5 |
| molybdenum | in the range of | 0 to 1.5 |
| nickel | in the range of | 0.35 to 10.0 |
| copper | in the range of | 0 to 4.5 |
| vanadium | in the range of | 0 to 0.5 |
| cobalt | in the range of | 0 to 1.5 |
| niobium | in the range of | 0 to 0.45 |
| titanium | in the range of | 0 to 1.5 |
| nitrogen | in the range of | 0 to 0.1, |

the remaining being iron and impurities resulting from manufacturing conditions. The chromium containing alloy has a hardness amounting to at least 45 HRC and at most 54 HRC as well as a minimum initial stress value of 950 $N/mm^2$ for initiation of stress corrosion cracking in a humid atmosphere.

Punch and counter punch plates fabricated from such type of chromium containing alloy and having at least the aforenoted favorable mechanical properties have been found to be capable of withstanding the high mechanical requirements as well as the highly corrosive stresses in particular stress corrosion cracking loads as occur, for example, in a humid atmosphere, particularly marine air and industrially contaminated air, i.e. in the operating environment of the punch and counter punch plates. As is known, particularly alloys which are resistant as such to corrosion, especially chromium containing alloys, are subject to stress corrosion cracking attacks.

A preferred embodiment of the inventive punch and counter punch plate is fabricated from a comparatively low-carbon chromium containing alloy essentially consisting of, each in percent by weight:

| | | |
|---|---|---|
| carbon | in a maximum of | 0.05 |
| silicon | in a maximum of | 1.0 |
| manganese | in a maximum of | 1.5 |
| chromium | in the range of | 11 to 17.5 |
| molybdenum | in a maximum of | 1.5 |
| nickel | in the range of | 3 to 10 |
| copper | in the range of | 1.5 to 4.5 |
| niobium | in the range of | 0 to 0.45 |
| titanium | in the range of | 0 to 1.5 |
| nitrogen | in a maximum of | 0.10, |

the remainder being iron and impurities resulting from manufacturing conditions. The chromium alloy has a hardness amounting to at least 45 HRC and at most 54 HRC as well as a minimum initial stress value of 950 $N/mm^2$ for initiation of stress corrosion cracking in a humid atmosphere.

A further advantageous embodiment of the inventive punch and counter punch plate is fabricated from a comparatively high-carbon chromium containing alloy essentially consisting of, each in percent by weight:

| | | |
|---|---|---|
| carbon | | 0.35 to 1.1 |
| silicon | in a maximum of | 1.0 |
| manganese | in a maximum of | 1.5 |
| chromium | in the range of | 11 to 17.5 |
| molybdenum | in a maximum of | 1.5 |
| nickel | in the range of | 0.35 to 1.0 |
| vanadium | in the range of | 0 to 0.42 |
| cobalt | in the range of | 0 to 1.5 |
| niobium | in the range of | 0 to 0.45 |
| titanium | in the range of | 0 to 1.5 |
| nitrogen | in the range of | 0 to 0.1, |

the remainder being iron and impurities resulting from manufacturing conditions. The chromium alloy has a hardness amounting to at least 45 HRC and at most 54 HRC as well as a minimum initial stress value of 950 $N/mm^2$ for initiation of stress corrosion cracking in a humid atmosphere.

The inventive punch and counter punch plates thus are fabricated from chromium containing alloys representing a hardenable or temperable chromium steel. The difficulty of selecting such types of chromium containing alloys can already be estimated considering that, during punching operations, the punching must be very precisely executed. For example, two sheets of paper lying atop each other must be punched such that the upper sheet, which first comes into contact with the cutting tool, is punched through, whereas the lower sheet may not possess any cut surfaces but only possess pressure lines. Such punching operations are, for example, required for manufacturing adhesive labels and the like. It is evident that the most minute unevenness or roughness in the punch and counter punch plates can lead to large scale production losses since such types of punching operations cannot result in continuously uniform punchings.

DETAILED DESCRIPTION OF THE PREFERRED EMBODIMENTS

The invention will be better understood and objects other than those set forth above will become apparent when consideration is given to the following detailed description thereof. Such description makes reference to the annexed table of comparative tests. All percent data are given in percent by weight and are given by way of example and not limitation.

Comparative tests using punch plates made of chromium containing steels designated with the letters "A", "B", "C", "D", "E", "F", "G" and "H" having a composition analysis and hardness according to annexed Table 1, were conducted using a punching or stamping machine performing 7,000 strokes per hour. After 430 hours, i.e. after 3.01 million strokes or reciprocations, slight impressions or indentations corresponding to the shape of the punching tool or knife were visually observable under oblique light incidence at each punching plate. Such impressions or indentations resulted from the high compressive and tensile stresses produced during punching. It was not possible to detect a difference between the two punching plates or punch and counter punch plates. Likewise, no corrosion damage caused by stress corrosion cracking was noticeable.

Comparative tests were conducted with samples of the chromium steels listed in Table 1 in a climatic or environmental chamber at an average temperature of +25° C. Continuous moistening of the surface of the samples was obtained by saturating the atmosphere with water vapor.

The samples of chromium steel "A", "B" and "C" showed a light brown coloration at the surface already after 24 hours. After a test duration of four weeks, these samples showed a uniform thin brown coating of rust. After removal of the coating, local surface corrosion was recognizable on the surface of these samples using a four-fold magnifying glass. The samples would no longer have been useful as punch plates without refinishing. The samples of chromium steels "D", "E", "F", "G" and "H" did not show any rusting phenomenon even after four weeks in the environmental chamber.

As will be evident from consideration of the annexed table, the samples "D", "E", "F", "G" and "H" which have the desired corrosion resistance, contain nickel as an essential component. In fact, the presence of nickel affects the properties of the chromium containing alloy and the punch and counter punch plates fabricated therefrom in three significant aspects, namely (i) nickel suppresses or at least reduces ferrite formation in the chromium containing alloy, (ii) nickel reduces micro segregation and thereby produces a homogenous chromium distribution throughout the chromium containing alloy after solidification so that the mechanical properties of the chromium containing alloy are uniform also throughout microregions, and (iii) the presence of nickel improves the resistance against stress corrosion cracking. The aforedescribed effects of nickel are also present in the comparatively high-carbon chromium containing alloy like the samples "D" and "E" in which the amount of nickel is limited to the range of 0.35 to 1.0 percent by weight.

The desired mechanical properties of the punch and counter punch plates fabricated from the aforementioned chromium containing alloys in principle can be obtained using conventional hardening or tempering processes. However, it has been found in practice that the mechanical properties of the punch and counter-punch plates are particularly favorably affected when the conventional so-called "Quetten method" is utilized for the hardening or tempering process. This specific hardening process which entails a cooling or quenching operation is carried out by clamping the punch or counter punch plate which has been heated to the predetermined hardening or tempering temperature, between two cooling plates which are made of steel, cast iron or copper and which have a lower temperature, if desired, room temperature. During such process, the cooling intensity is at a maximum at the start of the cooling operation and this cooling intensity uniformly and gradually decreases with increasing temperature of the cooling plates. As a result of this particular type of hardening operation, the internal hardness stresses of the punch and counter punch plates are minimized and, in fact, the inner or internal material stresses assume low values such that, in practice, the punch and counter punch plates retain their planarity or flatness and practically are not subject to warping or bending or other types of deformations.

While there are described present preferred embodiments of the invention, it is to be distinctly understood that the invention is not limited thereto, but may be otherwise variously embodied and practiced within the scope of the following claims.

TABLE 1

COMPARATIVE TEST SAMPLE DATA OF CHROMIUM CONTAINING ALLOYS

| STEEL | MATERIAL NUMBERS | CHEMICAL COMPOSITION IN % BY WEIGHT C | Si | Mn | P | S | Cr | Mo | Ni | V | Cu | Co | OTHERS | HARDNESS HRC |
|---|---|---|---|---|---|---|---|---|---|---|---|---|---|---|
| A | 1.2108 | 0.91 | 1.11 | 0.62 | 0.018 | 0.012 | 1.22 | | | | | | | 49 |
| B | 1.1525 | 0.82 | 0.18 | 0.22 | 0.017 | 0.019 | | | | | | | | 48 |
| C | 1.7228 | 0.51 | 0.33 | 0.72 | 0.023 | 0.018 | 1.10 | 0.17 | | | | | | 50 |
| D | 1.4122 | 0.38 | 0.42 | 0.60 | 0.022 | 0.014 | 15.95 | 0.92 | 0.74 | 0.06 | | | | 49 |
| E | 1.4528 | 1.05 | 0.35 | 0.48 | 0.024 | 0.015 | 17.20 | 1.01 | 0.38 | 0.10 | | 1.32 | | 51 |
| F | 1.4542 | 0.05 | 0.42 | 0.84 | 0.019 | 0.009 | 16.82 | | 3.94 | | 4.10 | | 0.34 Nb<br>0.06 Nb | 49 |
| G | | 0.04 | 0.28 | 0.33 | 0.006 | 0.003 | 12.31 | 0.10 | 8.46 | | 1.83 | | 0.85 Ti<br>0.31 Nb | 52 |
| H | | 0.04 | 0.30 | 0.29 | 0.007 | 0.002 | 13.94 | | 7.13 | | 1.52 | | 0.52 Ti | 51 |

Accordingly, what we claim is:

1. A punch and counter punch plate fabricated from a chromium containing alloy essential consisting of, each in percent by weight:

| | | |
|---|---|---|
| carbon | in a maximum of | 0.05 |
| silicon | in a maximum of | 1.0 |
| manganese | in a maximum of | 1.5 |
| chromium | in the range of | 11 to 17.5 |
| molybdenum | in a maximum of | 1.5 |
| nickel | in the range of | 3 to 10 |
| copper | in the range of | 1.5 to 4.5 |
| niobium | in the range of | 0 to 0.45 |
| titanium | in the range of | 0 to 1.5 |
| nitrogen | in a maximum of | 0.1, |

the remainder being iron and impurities resulting from manufacturing conditions;

said chromium containing alloy having a hardness amounting to at least 45 HRC and at most 54 HRC; and said chromium containing alloy having a minimum initial stress value of 950 N/mm$^2$ for initiation of stress corrosion cracking in a humid atmosphere.

2. The punch and counter punch plate as defined in claim 1, wherein:

said chromium containing alloy has a hardness in the range of about 48 HRC to 54 HRC.

3. The punch and counter punch plate as defined in claim 1, wherein:

the chromium containing alloy has an upsetting elasticity limit in excess of 1000 N/mm$^2$.

4. A punch and counter punch plate fabricated from a chromium containing alloy essentially consisting of, each in percent by weight:

| | | |
|---|---|---|
| carbon | | 0.35 to 1.1 |
| silicon | in a maximum of | 1.0 |
| manganese | in a maximum of | 1.5 |
| chromium | in the range of | 11 to 17.5 |
| molybdenum | in a maximum of | 1.5 |
| nickel | in the range of | 0.35 to 1.0 |
| vanadium | in the range of | 0 to 0.42 |
| cobalt | in the range of | 0 to 1.5 |
| niobium | in the range of | 0 to 0.45 |
| titanium | in the range of | 0 to 1.5 |
| nitrogen | in the range of | 0 to 0.1, |

the remainder being iron and impurities resulting from manufacturing conditions;

said chromium containing alloy having a hardness amounting to at least 45 HRC and at most 54 HRC; and said chromium containing alloy having a minimum initial stress value of 950 N/mm$^2$ for initiation of stress corrosion cracking in a humid atmosphere.

5. The punch and counter punch plate as defined in claim 4, wherein:

said chromium containing alloy has a hardness in the range of about 48 HRC to 54 HRC.

6. The punch and counter punch plate as defined in claim 4, wherein:

the chromium containing alloy has an upsetting elasticity limit in excess of 1000 N/mm$^2$.

* * * * *

UNITED STATES PATENT AND TRADEMARK OFFICE

CERTIFICATE OF CORRECTION

PATENT NO. : 4,880,481

DATED : November 14, 1989

INVENTOR(S) : WERNER JOSEF JERLICH et al

It is certified that error appears in the above-identified patent and that said Letters Patent is hereby corrected as shown below:

Column 5, line 27, after "alloy" please delete "essential"

Signed and Sealed this

Fifth Day of February, 1991

*Attest:*

HARRY F. MANBECK, JR.

*Attesting Officer*

*Commissioner of Patents and Trademarks*